United States Patent [19]

Yoshieda et al.

[11] Patent Number: 4,651,603

[45] Date of Patent: Mar. 24, 1987

[54] METHOD OF AND APPARATUS FOR CUTTING OFF SEPARABLE SLIDE FASTENER CHAIN

[75] Inventors: Keiichi Yoshieda, Kurobe; Kunio Miyazaki, Uozu, both of Japan

[73] Assignee: Yoshida Kogyo K. K., Tokyo, Japan

[21] Appl. No.: 780,087

[22] Filed: Sep. 25, 1985

[30] Foreign Application Priority Data

Sep. 28, 1984 [JP] Japan ..... 59-203721

[51] Int. Cl.[4] ..... B26D 5/28

[52] U.S. Cl. ..... 83/42; 83/210; 83/921

[58] Field of Search ..... 83/209, 210, 211, 212, 83/921, 221, 39, 13, 42

[56] References Cited

U.S. PATENT DOCUMENTS 3,776,078 12/1973 Perlman ..... 83/921 X
4,250,781 2/1981 Nakamura ..... 83/921 X
4,262,569 4/1981 Yoshieda et al. ..... 83/921 X
4,459,884 7/1984 Yoshieda et al. ..... 83/921 X
4,524,659 6/1985 Yunoki ..... 83/921 X

*Primary Examiner*—James F. Coan
*Attorney, Agent, or Firm*—Hill, Van Santen, Steadman & Simpson

[57] ABSTRACT

An elongate separable slide fastener chain is cut off into individual separable slide fasteners, the slide fastener chain having a plurality of longitudinally spaced element-free portions with pin-receptive boxes supported respectively thereon. The slide fastener chain is fed under tension in one direction, and then stopped to release the slide fastener chain of its tension. The leading and trailing ends of one of the boxes are clamped to position the slide fastener chain. Then, the slide fastener chain is severed across one of the element-free portions adjacent to the leading end of the box. With this arrangement, the slide fastener chain can be positioned accurately for severance and cut off into separable slide fasteners which are sightly in appearance and equal in length.

14 Claims, 13 Drawing Figures

METHOD OF AND APPARATUS FOR CUTTING OFF SEPARABLE SLIDE FASTENER CHAIN

BACKGROUND OF THE INVENTION

1. Field of the Invention

The present invention relates to a method of and an apparatus for cutting off an elongate separable slide fastener chain into individual separable slide fasteners.

2. Description of the Prior Art

Separable slide fasteners are finished by cutting off an elongate separable slide fastener chain into desired individual fastener lengths. In general, the slide fastener chain as it is fed is longitudinally tensioned. When the tensioned slide fastener chain is severed, it is sometimes cut off along inclined edges dependent on the timing of operation of the cutter, resulting in unsightly fastener products. On the other hand, when the slide fastener chain is cut off after its tension has been removed, the slide fastener chain tends to be displaced and cannot be severed to a desired length. Therefore, up to now, separable slide fasteners of equal lengths cannot be produced on a mass-production basis.

SUMMARY OF THE INVENTION

It is an object of the present invention to provide a method of cutting off an elongate separable slide fastener chain to individual separable slide fasteners which are sightly in appearance and equal in length.

Another object of the present invention is to provide an apparatus for cutting off an elongate separable slide fastener chain to individual separable slide fasteners which are sightly in appearance and equal in length.

According to the present invention, an elongate separable slide fastener chain is cut off into individual separable slide fasteners, the slide fastener chain having a plurality of longitudinally spaced element-free portions with pin-receptive boxes supported respectively thereon. The slide fastener chain is fed under tension in one direction, and then stopped to release the slide fastener chain of its tension in response to engagement of a first stopper with the leading end of one of the boxes. The trailing end of the box is then engaged by a second stopper to thereby clamp the box for positioning the slide fastener chain. The slide fastener chain is severed across one of the element-free portions adjacent to the leading end of the box.

With this arrangement, the slide fastener chain can be positioned accurately for severance and cut off into separable slide fasteners of sightly appearance. Since the slide fastener chain can be severed to accurate lengths, the produced slide fasteners are uniform in length and can be manufactured on a mass-production basis. The process for finishing separable slide fasteners can be automatized to manufacture accurate, high-quality slide fastener products.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
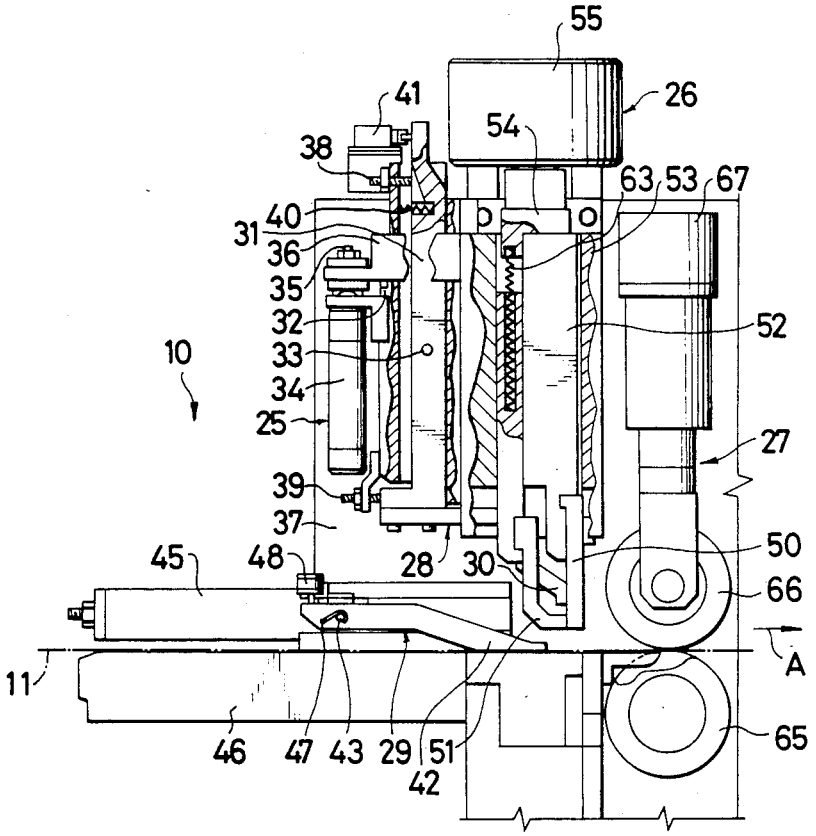
FIG. 1 is a side elevational view, partly in cross section, of an apparatus according to the present invention.
Figure 2:
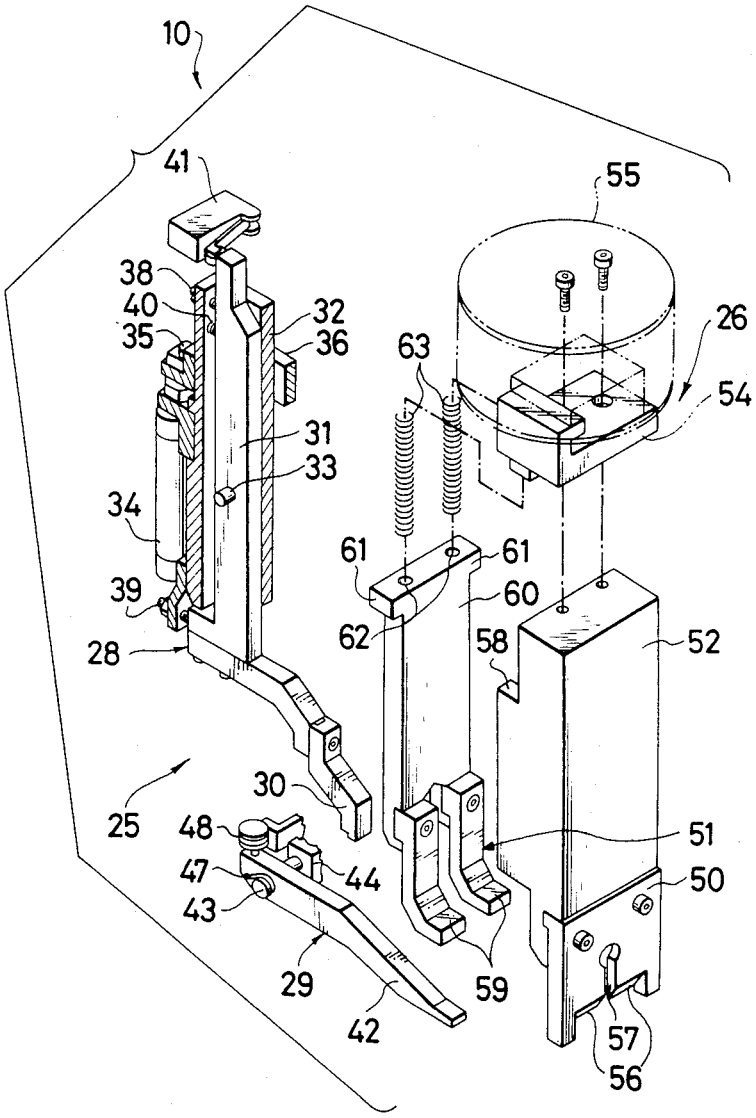
FIG. 2 is an exploded perspective view, partly cut away, of certain parts of the apparatus shown in FIG. 1.

The principles of the present invention are particularly useful when embodied in an apparatus, generally designated at 10, shown in FIGS. 1 and 2.

Figure 8A:
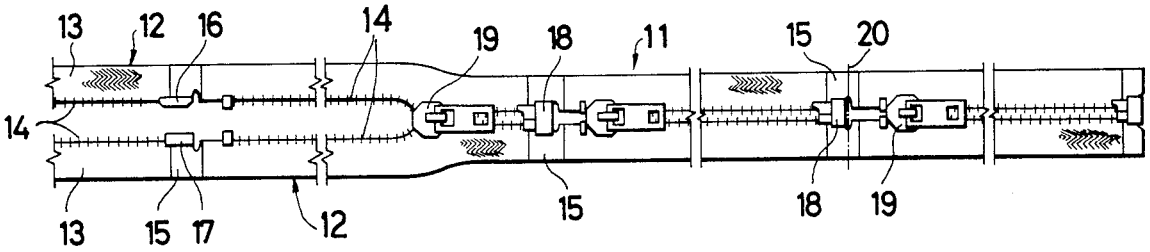
FIG. 8A is a fragmentary plan view of an elongate separable slide fastener chain.
Figure 8B:
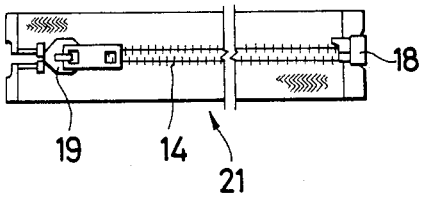
FIG. 8B is a plan view of an individual separable slide fastener cut off from the elongate separable slide fastener chain illustrated in FIG. 8A.

An elongate separable slide fastener chain to be cut off by the apparatus 10 is illustrated in FIG. 8A, generally indicated by the numeral 11. The elongate separable slide fastener chain is composed of a pair of slide fastener stringers 12, 12 each comprising a stringer tape 13 and a row of coupling elements 14 mounted on and along an inner longitudinal edge of the stringer tape 13. The separable slide fastener chain 11 has a plurality of longitudinally spaced, film-reinforced element-free portions 15 extending transversely across the stringer tapes 13. An insertion pin 16 and a box pin 17 are attached to the inner confronting edges of the stringer tapes 13 at the element-free portions 15. To the box pin 17, there is fixed a box 18 having a recess receptive of the insertion pin 16. The elongate slide fastener chain 11 also includes a slider 19 slidably mounted on the rows of coupling elements 14 and positioned between two adjacent element-free portions 15. The elongate slide fastener chain 11 thus assembled is cut off across the element-free portions 15 along a transverse line 20 at the end of each of the boxes 18 which faces away from the recess thereof, thereby producing an individual separable slide fastener 21 as shown in FIG. 8B.

The elongate slide fastener chain 11 will be longitudinally fed along a feed path through the apparatus 10 in such a direction that the end of each box 18 facing away from the recess thereof is the leading end and the box end where the recess is open for receiving the insertion pin 16 is the trailing end.

As illustrated in FIG. 1, the apparatus 10 is generally composed of a stopper mechanism 25, a cutter mechanism 26, and a feed mechanism 27.

As shown in FIGS. 1 and 2, the stopper mechanism 25 essentially comprises a first stopper 28 and a second stopper 29. The first stopper 28 includes a first stopper finger 30 fixed to the lower end of a vertical lever 31 mounted in and pivotably attached to a casing 32 by a pivot pin 33. The casing 32 supports thereon an air cylinder 34 having its piston rod 35 connected to a bracket 36 fixed to a base 37. The casing 32 is vertically movable by the air cylinder 34 to move the first stopper finger 30 between a lower operative position and an upper inoperative position. As shown in FIG. 1, upper and lower adjustable stops 38, 39 are supported on the casing 32 for limiting the tilting movement of the lever 31. The lever 31 is normally urged by a compression spring 40 to turn clockwise (FIG. 1) about the pivot pin 33, the spring 40 acting between the casing 32 and the lever 31. When the first stopper finger 30 is in the lower operative position, it engages the leading end of the box 18 on the stringer chain 11 fed through the apparatus 10 in the direction of the arrow A (FIG. 1) to stop the box 18 with its leading end aligned with a cutting position in the cutter mechanism 26. As the box 18 abuts against the first stopper finger 30, the first stopper finger 30 is slightly pushed thereby to cause the lever 31 to be turned counterclockwise against the bias of the spring 40 until the upper end of the lever 31 actuates a microswitch 41 mounted on the casing 32.

Figure 5:
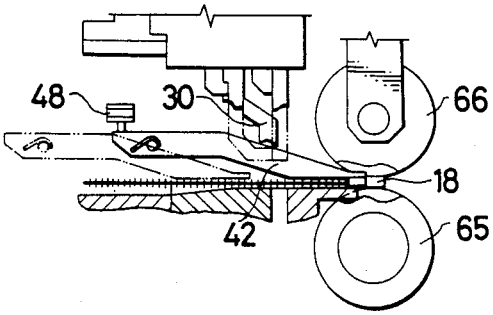
FIG. 5 is a fragmentary side elevational view of the second stopper as it is advanced.

The second stopper 29 comprises a second stopper finger normally positioned upstream of the first stopper finger 30 in the feeding direction A. The second stopper finger 42 is pivotably supported by a pivot pin 43 on a block 44 coupled to the piston rod of an air cylinder 45 mounted on a table 46 connected to the base 37. The second stopper finger 42 is normally urged by a torsion spring 47 to turn about the pivot pin 43 in the direction to be pressed against the upper surface of the stringer chain 11. The second stopper finger 42 is movable horizontally by the air cylinder 45 between a retracted position (FIG. 1) and an advanced position (FIG. 5). When the second stopper finger 42 is in the retracted position, it engages the trailing end of the box 18. The second stopper finger 42 can be lifted off engagememt with the stringer chain 11 by means of an air cylinder 48 supported on the block 44 and acting on the end of the second stopper finger 42 adjacent to the pivot pin 43.

Figure 4A:
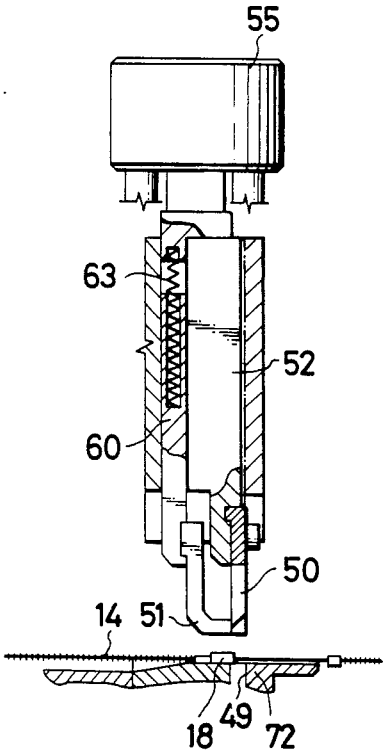
FIGS. 4A and 4B are vertical cross-sectional views of a cutter mechanism having a cutter and presser pads, the views showing the manner in which the cutter mechanism operates.

The cutter mechanism 26, which is positioned generally downstream of the stopper mechanism 25 in the feeding direction A, comprises a cutter 50 for cutting off the stringer chain 11 and a presser pad assembly 51 for pressing the stringer chain 11. The cutter 50 is attached to the lower end of a slide 52 vertically movable in a housing 53 fastened to the base 37. The slide 52 is attached at its upper end to a block 54 mounted on the piston rod of an air cylinder 55 fixed to the base 37. Therefore, the slide 52 is vertically slidable by the air cylinder 55. The slide 52 has a pair of shoulders 58 (only one shown in FIG. 2) spaced laterally from each other. The cutter 50 is composed of a pair of cutter blades 56, 56 spaced from each other by a central recess 57 which has substantially the same width as that of the box 18. The table 46 has a vertical slot 49 (FIGS. 4A and 4B) defined therein in vertical alignment with the cutter 50, the slot 49 defining a cutting position. The presser pad assembly 51 has a pair of presser pads 59, 59 spaced from each other for engagement with the stringer tapes 13, 13, respectively. The first stopper finger 30 is positioned between the presser pads 59, 59. The presser pads 59, 59 are held in slidable engagement with the rear surface of the cutter 50. The presser pads 59, 59 are fixed to the lower end of a vertical plate 60 having on its upper end a pair of ears 61, 61 engageable with the shoulders 58, respectively. The vertical plate 60 has a pair of vertical holes 62, 62 in which there is partly received a pair of compression springs 63, 63 with their upper ends held against the lower surface of the block 54. The presser pads 59, 59 are normally urged under the forces of the compression springs 63, 63 to move downwardly with respect to the cutter 50. When the air cylinder 55 is actuated, the cutter 50 and the presser pads 59, 59 are moved together downwardly, and then the presser pads 59, 59 are first brought into engagement with the stringer tapes 13, 13. As the slide 52 descends further, the presser pads 59, 59 are resiliently pressed against the stringer tapes 13, 13, followed by arrival of the cutter 50 at the stringer tapes 13, 13 to cut off the same.

Figure 6:
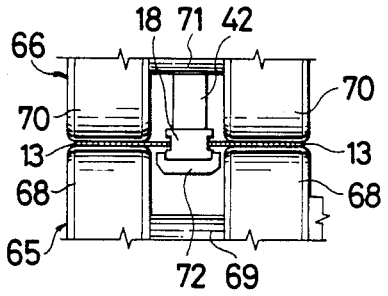
FIG. 6 is a fragmentary elevational view of a pair of feed rollers.

The feed mechanism 27 includes a feed roller 65 rotatably mounted on the base 37 and a presser roller 66 rotatably mounted on the lower end of the piston rod of an air cylinder 67 supported on the base 37. The feed and presser rollers 65, 66 are located downstream of the cutter mechanism 26 in the feeding direction A. The feed roller 65 is drivable by a suitable drive source to pull the slide fastener chain 11 pressed by the presser roller 66 down against the feed roller 65. As shown in FIG. 6, the feed roller 65 is composed of a pair of coaxial rolls 68, 68 spaced axially from each other and coupled to each other by a shaft 69. The presser roller 66 is composed of a pair of coaxial rolls 70, 70 spaced axially from each other and coupled to each other by a shaft 71. A guide 72 is disposed between the rolls 68, 68 for guiding the boxes 18 and the intermeshing rows of coupling elements 14. When the presser roller 66 is moved downwardly by the air cylinder 67 toward the feed roller 65, the presser rolls 70, 70 press the stringer tapes 13, 13 against the feed rolls 68, 68, respectively, to feed the stringer chain 11 under tension through rotation of the feed rolls 68, 68. When the presser roller 66 is lifted by the air cylinder 67 away from the feed roller 65, the advancing movement of the stringer chain 11 is stopped, and hence the stringer chain 11 is released of its tension. The air cylinder 67 is controlled by a signal from the microswitch 41 to move the presser roller 66 upwardly.

Figure 3A:
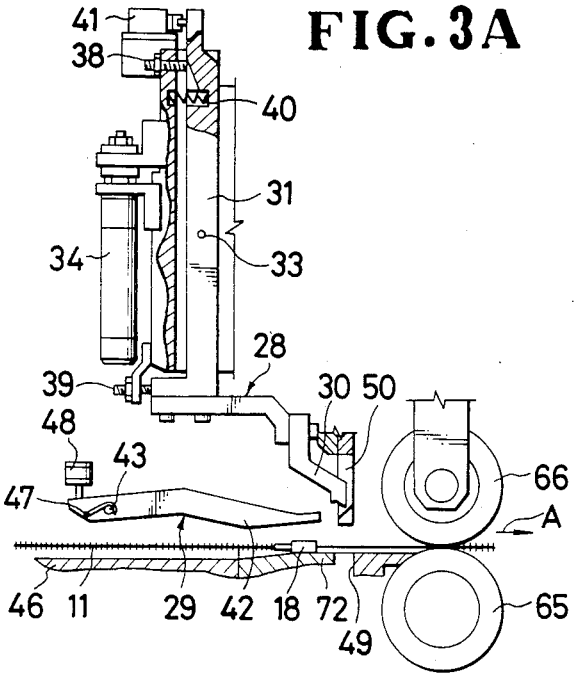
FIGS. 3A through 3D are side elevational views, partly in cross section, of first and second stoppers as they operate in successive steps.
Figure 3B:
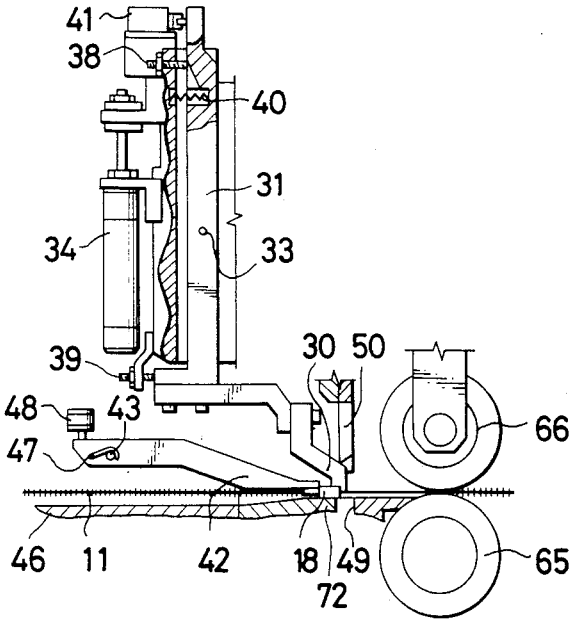
Figure 3C:
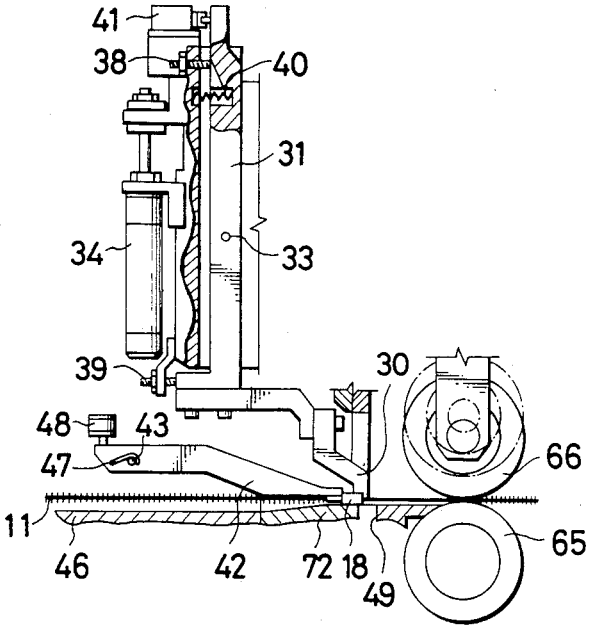
Figure 3D:
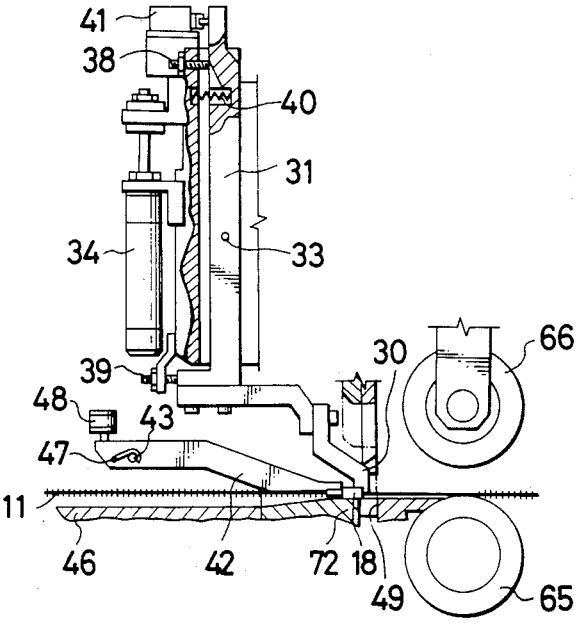
Figure 4B:
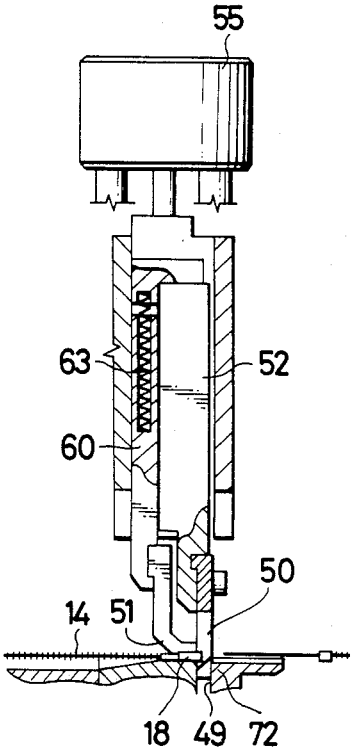
Figure 7:
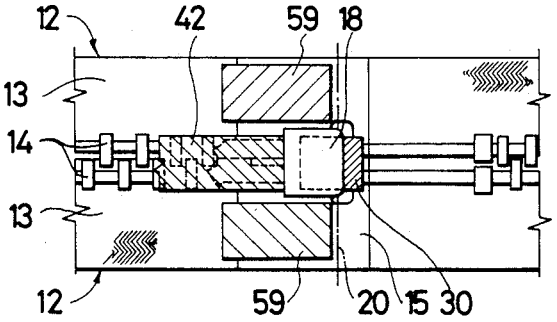
FIG. 7 is an enlarged plan view, partly in cross section, showing the relative positions of the first stopper, the second stopper, and the presser pads.

Operation of the apparatus thus constructed is as follows: The slide fastener stringer 11 is continuously fed under tehsion in the direction of the arrow A (FIG. 3A) by the feed and presser rollers 65, 66. At this time, the air cylinder 34 is inactivated to keep the first stopper 28 in the elevated position, and the air cylinder 48 is actuated to lift the second stopper finger 42. When the box 18 reaches the cutting position, it is detected by a sensor (not shown) on the guide 72, which issues a signal for actuating the air cylinder 34 to lower the first stopper finger 30 until it engages the leading end of the box 18, as shown in FIG. 3B. The box 18 pushes the first stopper finger 30 to tilt the lever 31 counterclockwise about the pin 33 as illustrated in FIG. 3C. The microswitch 41 is now turned on to actuate the air cylinder 67 to lift the presser roller 66 away from the feed roller 65. The slide fastener stringer 11 is stopped and released from the tension. At the same time that the first stopper finger 30 is lowered, the air cylinder 48 is inactivated to allow the second stopper finger 42 to move downwardly under the resiliency of the spring 47 into engagement with the upper surface of the box 18, as shown in FIG. 3B. As the box 18 pushes the first stopper finger 30, the second stopper finger 42 further descends to engage against the upper surface of the stringer 11 and is temporarily spaced from the trailing end of the box 18. When the stringer 11 is released, the first stopper finger 30 is moved back under the force of the compression spring 40 to move back the box 18 until its trailing end engages the second stopper finger 42, as shown in FIG. 3D. At this time, the first stopper finger 30 engages the leading end of the box 18. Therefore, the box 18 is clamped between the first and second stopper fingers 30, 42 as shown in FIG. 7 to position the element-free portion 15 accurately in alignment with the cutting position. Thereafter, the air cylinder 55 is actuated to move the presser pads 59, 59 downwardly into engagement with the stringer tapes 13, 13, respectively, as shown in FIG. 7. Then, the cutter 50 is moved further downwardly through the stringer tapes 13, 13 into the slot 49 to cut off the stringer chain 11 into an individual separable slide fastener along the transverse line 20, as shown in FIGS. 4B and 7.

After the stringer chain 11 has been severed, the air cylinder 67 is actuated to lower the presser roller 66 toward the feed roller 65 for discharging the severed slide fastener in the direction of the arrow A. The cutter 50 and the first stopper finger 30 are moved upwardly. The second stopper finger 42 is moved in the direction of the arrow A by the air cylinder 45 toward the feed and presser rollers 65, 66 for thereby advancing the box 18 in abutment against the trailing end thereof. The portions of the stringer tapes 13, 13 which lie downstream of the rear end of the box 18 are then gripped between the feed and presser rollers 65, 66, so that the stringer chain 11 can now be fed by the feed and presser rollers 65, 66. The aforesaid cycle of operation is repeated to cut off the elongate slide fastener stringer chain 11 into successive individual separable slide fasteners.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of cutting off an elongate separable slide fastener chain into individual separable slide fasteners, the slide fastener chain having a plurality of longitudinally spaced element-free portions with pin-receptive boxes supported respectively thereon, said method comprising the steps of:

(a) feeding the slide fastener chain under tension in one direction;

(b) engaging the leading end of one of the boxes to stop the slide fastener chain and for releasing the slide fastener chain of its tension;

(c) simultaneously engaging the trailing end of said one box to thereby clamp said one box for positioning the slide fastener chain; and (d) severing the slide fastener chain across one of the element-free portions adjacent to the leading end of said one box.

2. A method of cutting off an elongate separable slide fastener chain into individual separable slide fasteners, the slide fastener chain having a plurality of longitudinally spaced element-free portions with pin-receptive boxes supported respectively thereon, said method comprising the steps of:

(a) feeding the slide fastener chain under tension in one direction with a pair of feed and presser rollers as they coact with each other;

(b) positioning a first stopper finger in engagement with the leading end of one of the boxes;

(c) moving the feed and presser rollers relatively out of coacting relation to stop the slide fastener chain and for releasing the slide fastener chain of its tension;

(d) positioning a second stopper finger in engagement with the trailing end of said one box for thereby clamping said one box between the first and second stopper fingers; and (e) moving a cutter across the slide fastener chain to sever the same across one of the element-free portions adjacent to the leading end of said one box.

3. A method according to claim 2, the feed and presser rollers being moved relatively out of coacting relation in response to engagement of the first stopper finger with the leading end of said one box.

4. A method according to claim 2, including the step of, after the slide fastener chain has been severed, moving the second stopper finger in said one direction to push said one box toward the feed and presser rollers until the slide fastener chain is engaged by the feed and presser rollers.

5. An apparatus for cutting off an elongate separable slide fastener chain into individual separable slide fasteners, the slide fastener chain having a plurality of longitudinally spaced element-free portions with pin-receptive boxes supported respectively thereon, said apparatus comprising:

(a) a feed mechanism for feeding the slide fastener chain under tension in one direction;

(b) a stopper mechanism disposed upstream of said feed mechanism in said one direction for stopping the slide fastener chain in cooperation with said feed mechanism, said stopper mechanism having a first stopper for engaging the leading end of one of the boxes and a second stopper for engaging the trailing end of said one box, said feed mechanism being responsive to engagement of said first stopper with the leading end of said one box for stopping the slide fastener chain and for releasing its tension; and (c) a cutter mechanism disposed between said feed mechanism and said stopper mechanism for severing said slide fastener chain across one of the element-free portions adjacent to the leading end of said one box.

6. An apparatus according to claim 5, said first stopper comprising a first stopper finger for engaging the leading end of said one box and an air cylinder for moving said first stopper finger between an operative position to engage the leading end of said one box and an inoperative position upwardly remote from said chain to disengage from the leading end of said one box.

7. An apparatus according to claim 5, said feed mechanism being disposed downstream of said cutter mechanism, said feed mechanism being operative to discharge the severed slide fastener chains.

8. An apparatus according to claim 7, said first stopper being vertically movable out of the path of the chain, and said second stopper being horizontally movable past said cutter mechanism for advancing the unsevered chain to said feed mechanism.

9. An apparatus according to claim 5, said first stopper having means for moving the stopped chain in a reverse direction for effecting the release of the tension on the chain.

10. An apparatus according to claim 5, said cutter mechanism comprising a cutter for severing the slide fastener chain, a presser pad assembly resiliently coupled to said cutter for pressing the slide fastener chain in advance of severance of said slide fastener chain by said cutter, and an air cylinder for moving said cutter to sever the slide fastener chain.

11. An apparatus according to claim 10, said cutter comprising a pair of blades spaced from each other by a space receptive of said one box.

12. An apparatus for cutting off an elongate separable slide fastener chain into individual separable slide fasteners, the slide fastener chain having a plurality of longitudinally spaced element-free portions with pin-receptive boxes supported respectively thereon, said apparatus comprising:

(a) a feed mechanism for feeding the slide fastener chain under tension in one direction;

(b) a stopper mechanism disposed upstream of said feed mechanism in said one direction for stopping the slide fastener chain in cooperation with said feed mechanism, said stopper mechanism having a first stopper for engaging the leading end of one of the boxes and a second stopper for engaging the trailing end of said one box, said feed mechanism being responsive to engagement of said first stopper with the leading end of said one box for stopping and releasing the slide fastener chain of its tension, said second stopper comprising a stopper finger for engaging the trailing end of said one box and an air cylinder for angularly moving said stopper finger into and out of engagement with the trailing end of said one box; and (c) a cutter mechanism disposed between said feed mechanism and said stopper mechanism for severing said slide fastener chain across one of the element-free portions adjacent to the leading end of said one box.

13. An apparatus according to claim 12, further including an additional air cylinder for moving said second stopper finger toward and away from said feed mechanism.

14. An apparatus for cutting off an elongate separable slide fastener chain into individual separable slide fasteners, the slide fastener chain having a plurality of longitudinally spaced element-free portions with pin-receptive boxes supported respectively thereon, said apparatus comprising:

(a) a feed mechanism for feeding the slide fastener chain under tension in one direction;

(b) a stopper mechanism disposed upstream of said feed mechanism in said one direction for stopping the slide fastener chain in cooperation with said feed mechanism, said stopper mechanism having a first stopper for engaging the leading end of one of the boxes and a second stopper for engaging the trailing end of said one box, said feed mechanism being responsive to engagement of said first stopper with the leading end of said one box for stopping and releasing the slide fastener chain of its tension, said first stopper comprising a stopper finger for engaging the leading end of said one box, an air cylinder for moving said stopper finger between an operative position to engage the leading end of said on box and an inoperative position to disengage from the leading end of said one box, a lever to which said stopper finger is fixed, and a casing in which said lever is pivotably mounted, said air cylinder being operatively connected to said casing; and (c) a cutter mechanism disposed between said feed mechanism and said stopper mechanism for severing said slide fastener chain across one of the element-free portions adjacent to the leading end of said box.

* * * * *